United States Patent [19]

Woodall et al.

[11] Patent Number: 4,682,446

[45] Date of Patent: Jul. 28, 1987

[54] APPARATUS AND METHOD FOR SEATING CARBON BRUSHES IN MOTORS OR THE LIKE

[76] Inventors: Bobbie L. Woodall, P.O. Box 1025; Jerry H. Nuttall, P.O. Box 272, both of, Springerville, Ariz. 85938

[21] Appl. No.: 923,892

[22] Filed: Oct. 28, 1986

[51] Int. Cl.[4] ..... B24B 1/00; B24D 3/00

[52] U.S. Cl. ..... 51/281 R; 51/395; 51/402

[58] Field of Search ..... 51/395, 396, 397, 398, 51/401, 402, 405, 407, 281 R, DIG. 34

[56] References Cited

U.S. PATENT DOCUMENTS

| | | | |
|---|---|---|---|
| 781,876 | 2/1905 | Gardner | 51/395 |
| 1,029,406 | 6/1912 | Staynes | 51/395 |
| 2,725,697 | 12/1955 | Christensen | 51/281 R |
| 3,029,562 | 4/1962 | Kroen | 51/281 R X |
| 3,105,331 | 10/1963 | Reardon et al. | 51/281 R |
| 3,641,719 | 2/1972 | Yang | 51/402 |
| 4,175,930 | 11/1979 | Sakulevich et al. | 51/281 R |
| 4,291,508 | 9/1981 | Prunier | 51/395 |

*Primary Examiner*—Robert P. Olszewski

*Attorney, Agent, or Firm*—Don J. Flickinger; Jordan M. Meschkow

[57] ABSTRACT

A seating material for assisting in the seating of brushes on motors or the like to conform a surface of the brushes to the contour of a commutator comprises a flexible base material having upper and lower major surfaces, a layer of pressure sensitive adhesive on at least a portion of the lower major surface, and alternating strips of abrasive and pressure sensitive adhesive disposed on at least a portion of the upper major surface. The strips are generally parallel and disposed at an angle with respect to the leading edge of the brushes. The material is cut and secured to the commutator of a motor. The brushes are then placed in contact with the seating material and the commutator rotated in the direction of its normal operation. The carbon dust created collects in the alternating strips of adhesive thus reducing cleanup efforts.

11 Claims, 8 Drawing Figures

APPARATUS AND METHOD FOR SEATING CARBON BRUSHES IN MOTORS OR THE LIKE

BACKGROUND OF THE INVENTION

Field of the Invention

This invention relates generally to motors and, more particularly, to an apparatus and method for seating carbon brushes on the commutators of brush-type motors or generators.

It is well known that many motors and generators are in use world-wide and one of the most difficult and tedious tasks is to seat the carbon brushes so that the brushes fit the contour of the commutator. By "seating" we provide a concave arc in the contact surface of the brush complimentary to the convex portion of the periphery of the commutator upon which the brush rides. In the lifetime of a motor, generator or the like, it may be necessary to resurface the brushes at various intervals in order to maintain the efficiency of the machine.

A method of accomplishing this, is to place a carbon brush in its respective brush holder and then place a small piece of sandpaper between the commutator and the brush with the abrasive surface facing the brush. Pressure is then applied to the brush and the sandpaper moved back and forth. This is continued until the brush has achieved substantially the same curvature as the commutator. Of course, this process must be repeated with every brush rendering the process tedious and time consuming.

After all of the brushes have been seated in the above manner, they must be pulled from their respective holders and numbered to insure their proper location. The motor or generator must then be thoroughly cleaned to remove carbon dust and sand from the commutator and its surroundings. The brushes can then be replaced in their proper holders.

Another seating technique first requires the removal of the old brushes and the substitution therefore with new ones. A large abrasive stone is then placed on the commutator while the motor or generator is rotating at maximum speed, and about ten pounds per pressure is applied to the stone moving it from side to side on the commutator. As the abrasive material is worn from the stone, it in turn wears away the surface of the brush. Unfortunately, this process does not assure a good seat and still results in the creation of a substantial amount of carbon dust which must be cleaned from the motor or generator before it can be placed back in production. Furthermore, this approach can significantly reduce the useful life of the commutator.

U.S. Pat. No. 2,725,697 entitled PROCESS FOR SEATING THE BRUSHES OF AN ELECTRIC COMMUTATOR, discloses a seating process comprising the application by brushing, spraying or the like of abrasive particles suspended in a liquid vehicle having a resin or resin forming substance therein to form a peelable coating on the surface of the commutator. After the abrasive coating has dried and hardened, the commutator is rotated with the brushes in contact with the abrasive coating and in this way, the brushes are ground or resurfaced so that the surfaces thereof have the same curvature and contour as the commutator surface. When the brushes have been ground to fit the circular contour of the commutator, the thin plastic film is peeled from the surface of the commutator, bringing the bare surface thereof into contact with the brushes which are now properly seated so as to provide maximum contact between the brush surfaces and the commutator.

U. S. Pat. No. 3,105,331 entitled BRUSH SEATING TECHNIQUE, discloses a method wherein a thin coating of liquid having abrasive particles suspended therein is applied to the surface of a rotating current collector with the surface of the unseated engaging the current collector. The liquid brush seating agent is preferably water having colloidal silica and suspended particles of aluminum oxide dispersed therein. The brush is seated by continuing to rotate the commutator with a surface of the brush in contact therewith. Unfortunately, the methods associated with the above two cited patents require extensive cleaning of the commutator and its surroundings to remove accumulated carbon dust and abrasive particles.

SUMMARY OF THE INVENTION

It is an object of the present invention to provide an improved apparatus and method for seating carbon brushes in motors, generators or the like.

It is a further object of the present invention to provide a carbon brush seating technique which may be performed quickly while at the same time reduces the need for extensive cleanup procedures.

It is yet another object of the present invention to provide novel means for accomplishing the seating of carbon brushes in motors, generators or the like.

According to a broad aspect of the invention there is provided sheet material for assisting in the seating of brushes of a motor, generator or the like to conform the surface of the brushes to the contour of the commutator. The sheet material includes a flexible base having upper and lower major surfaces. A layer of pressure sensitive adhesive is exposed on at least a portion of the lower major surface. The upper major surface has disposed thereon alternating strips of abrasive and pressure sensitive adhesive. This sheet material may be cut and its lower surface secured to the commutator. The brushes are then placed in their respective holders and the several spring tension clips emplaced. The commutator is then manually turned in the direction of normal operation until all of the brushes obtain the same curvature as the commutator.

The above and other objects, features and advantages of the present invention will be more clearly understood from the following detailed description taken in conjuction with the accompanying drawings, in which:

DETAILED DESCRIPTION OF THE PREFERRED EMBODIMENT

Figure 1:
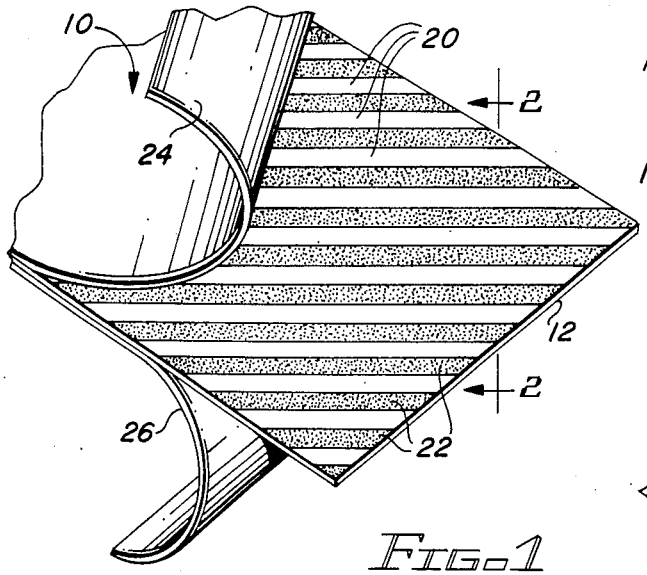
FIG. 1 is perspective view of the inventive sheet material utilized in the seating of brushes in accordance with the present invention.
Figure 2:
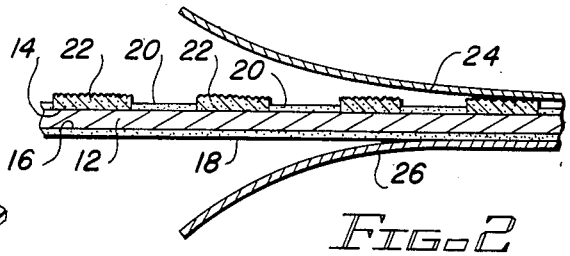
FIG. 2 is a cross-sectional view taken along the line 2—2 in FIG. 1.

Referring to FIGS. 1 and 2, there is shown a sheet of material 10 which includes a layer of base material 12 (e.g. paper) having upper and lower major surface 14 and 16 respectively. Disposed over at least a portion of lower surface 16 is a layer of pressure sensitive adhesive 18. Disposed on upper surface 14 are alternating, substantially parallel strips of pressure sensitive adhesive 20 and abrasive 22. The term abrasive as used herein refers to granular materials of the type normally used for cutting and polishing purposes as exemplified by silicon carbide, aluminum oxide, quartz sand, carborundum and emery. To protect the adhesive portions of both the upper and lower surfaces, protective sheets (e.g. paper) 24 and 26 respectively, cover the alternating strips of adhesive and abrasive 20 and 22 and adhesive layer 18. Prior to use of the material, protective sheets 24 and 26 are removed.

Figure 3:
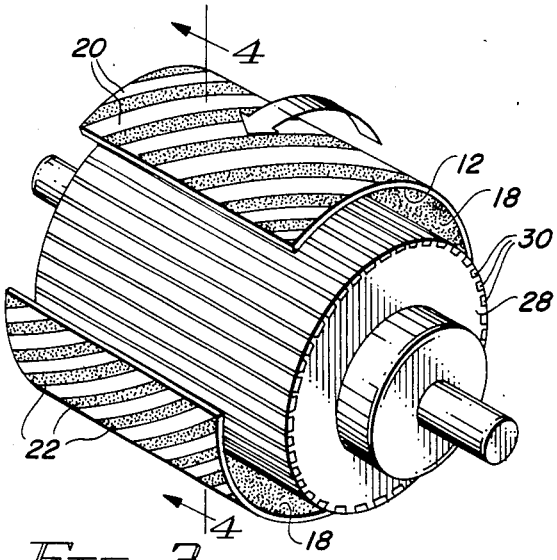
FIG. 3 is a perspective view illustrating the deployment of the sheet material of FIG. 1 around the commutator of a motor.
Figure 4:
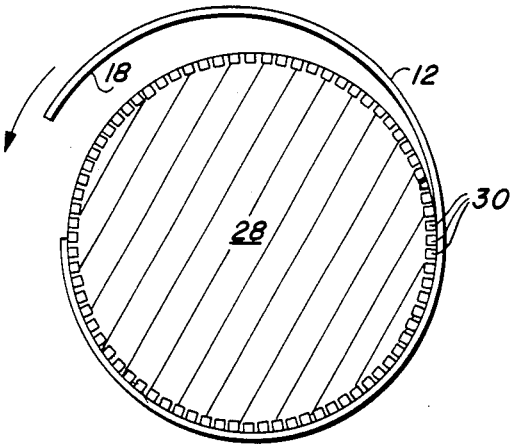
FIG. 4 is a cross-sectional view taken along line 4—4 of FIG. 3.

FIGS. 3–8 illustrate how the material of FIG. 1 may be deployed on a commutator and the brushes seated. Referring first to FIGS. 3 and 4, the sheet material of FIGS. 1 and 2 is first cut to size and the protective upper and lower layers 24 and 26 removed. The lower adhesive layer 18 is then secured on commutator 28 which includes a plurality of generally parallel commutator bars 30 as is shown if FIGS. 3 and 4.

Figure 5:
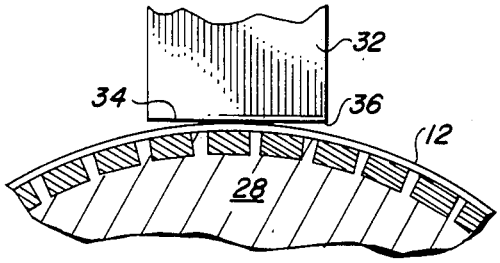
FIGS. 5–8 illustrate the process of seating the brush of an electric motor or the like utilizing the material of FIG. 1.

After the material is secured on commutator 28, brushes 32 are placed in their respective holders (not shown) and their associated spring tension clips (also not shown) emplaced. The result is shown in FIG. 5 wherein a lower surface 34 of brush 32 and having a leading edge 36 bears against that portion of the material having the alternating strips of abrasive and adhesive thereon. It is to be noted that the alternating parallel strips of abrasive and adhesive as shown in FIGS. 1 and 3 are angled with respect to the direction of the commutator bars 30 and the leading edge 36 of brush 32. Typically, the alternating strips may be angled 45° with respect to the edges of base material 12. This enhances the efficiency of the seating operation.

Figure 6:
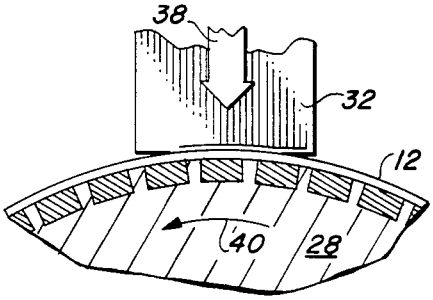
Figure 7:
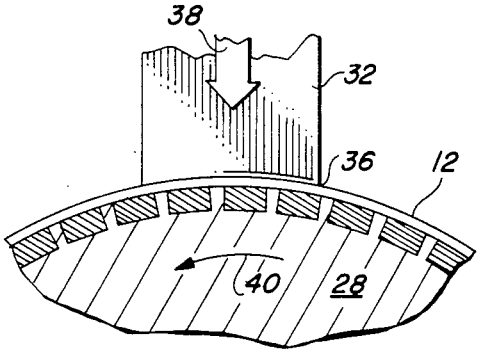

Referring now to FIG. 6, the action of the spring tension clips forces brush 32 against seating material 12 as is indicated by arrow 38. The commutator is then turned very slowly (e.g. by hand) in the same direction as it will turn during operation as is indicated by arrow 40 until all the brushes obtain the same curvature as commutator 28. This is shown in FIG. 7. As the commutator was turned and carbon removed from the brushes, the carbon particles fall into the adhesive strips 20 which form collector grooves disposed between abrasive strips 22. In this manner, substantially no carbon dust is released into the air or collects on the commutator or adjacent equipment.

Figure 8:
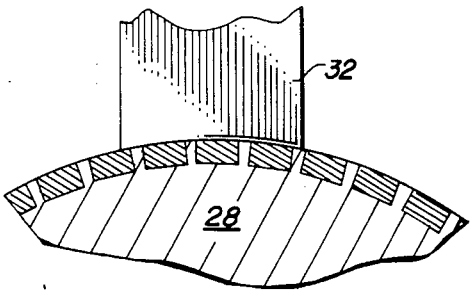

The abrasive sheet material may now be removed leaving a brush having a surface which conforms closely to the contour of the commutator as is shown in FIG. 8.

The disclosed seating technique not only reduces down time but always results in proper seating of the brushes without any special wear on the commutator or excessive cleanup.

The above is given by way of example only. Changes in form and details may be made by one skilled in the art without departing from the scope of the invention as defined by the appended claims.

We claim:

1. Apparatus for receiving the brushes of a motor, generator, or the like to conform a surface of said brushes to the contour of a commutator, comprising:

a flexible based material having upper and lower major surfaces;

a layer of pressure sensitive adhesive disposed on at least a portion of said lower major surface; and alternating strips of abrasive and pressure sensitive adhesive disposed on at least a portion of said upper major surface.

2. An apparatus according to claim 1, further comprising first and second peel-off protective layers disposed respectively over said layer of adhesive on said lower major surface and said alternating strips of abrasive and adhesive on said upper major surface.

3. An apparatus according to claim 2, wherein said alternating strips of abrasive and pressure sensitive adhesive are generally parallel.

4. An apparatus according to claim 3, wherein said alternating strips of abrasive and pressure sensitive adhesive are orientated at a angle with respect to the leading edge of said brushes.

5. An apparatus according to claim 4, wherein said alternating strips of abrasive and pressure sensitive adhesive are disposed at an angle of approximately 45° with respect to the leading edge of said brushes.

6. An apparatus according to claim 3, wherein said base material is paper.

7. An apparatus according to claim 6, wherein said abrasive is a selected granular material secured to said base material.

8. A method of receiving the brushes of a motor or the like to conform the surface of said brushes to the contour of said motor commutator, comprising:

securing the sheet of seating material to said commutator, said sheet having alternating strips of pressure sensitive adhesive and abrasive disposed thereon;

placing said brushes in contact with said seating material; and rotating said commutator.

9. A method according to claim 8, wherein said commutator is manually rotated in a direction consistent with its normal operation.

10. A method according to claim 9, wherein said alternating strips are substantially parallel and orientated at an angle with respect to a leading edge of said brushes.

11. A method according to claim 9, wherein said sheet of seating material has disposed on a lower surface thereof a layer of pressure sensitive adhesive.

* * * * *